US008573956B2

(12) United States Patent
Suzuki

(10) Patent No.: US 8,573,956 B2
(45) Date of Patent: Nov. 5, 2013

(54) MULTIPLE STAGE DRY PUMP

(75) Inventor: Toshio Suzuki, Chigasaki (JP)

(73) Assignee: Ulvac, Inc., Chigasaki-Shi (JP)

( * ) Notice: Subject to any disclaimer, the term of this patent is extended or adjusted under 35 U.S.C. 154(b) by 118 days.

(21) Appl. No.: 13/123,090

(22) PCT Filed: Oct. 7, 2009

(86) PCT No.: PCT/JP2009/005224

§ 371 (c)(1),
(2), (4) Date: Apr. 7, 2011

(87) PCT Pub. No.: WO2010/041445

PCT Pub. Date: Apr. 15, 2010

(65) Prior Publication Data

US 2011/0194961 A1 Aug. 11, 2011

(30) Foreign Application Priority Data

Oct. 10, 2008 (JP) ..... 2008-263938

(51) Int. Cl.
*F01C 21/06* (2006.01)
*F03C 2/00* (2006.01)
*F03C 4/00* (2006.01)

(52) U.S. Cl.
USPC ..... 418/85; 418/9; 418/92; 418/101; 418/206.1

(58) Field of Classification Search
USPC ..... 418/9, 83–85, 92, 96, 100, 101, 418/206.1–206.8
See application file for complete search history.

(56) References Cited

U.S. PATENT DOCUMENTS

| | | | | |
|---|---|---|---|---|
| 2,938,664 | A * | 5/1960 | Noller | 418/85 |
| 4,983,106 | A * | 1/1991 | Wright et al. | 418/85 |
| 5,660,535 | A | 8/1997 | Kobus et al. | |
| 6,544,020 | B1 * | 4/2003 | Bahnen et al. | 418/9 |
| 2004/0091380 | A1 | 5/2004 | Kriehn et al. | |

FOREIGN PATENT DOCUMENTS

| | | |
|---|---|---|
| CN | 101124409 | 2/2008 |
| JP | 9-502001 | 2/1997 |
| JP | 2001-020664 | 1/2001 |
| JP | 2001-20884 | 1/2001 |
| JP | 2001-329985 | 11/2001 |
| JP | 2003-166483 | 6/2003 |
| JP | 2004-506140 | 2/2004 |
| JP | 2004-300964 | 10/2004 |

OTHER PUBLICATIONS

International Search Report from corresponding PCT Application No. PCT/JP2009/005224 dated Dec. 22, 2009. English translation attached.
Office Action from corresponding Chinese Application No. 200980139935.5 dated Apr. 19, 2013. Partial English translation attached.

* cited by examiner

*Primary Examiner* — Theresa Trieu
(74) *Attorney, Agent, or Firm* — Grossman, Tucker, Perreault & Pfleger, PLLC

(57) ABSTRACT

A dry pump includes: a plurality of cylinders; a pump chamber formed in each of the cylinders; a division wall separating pump chambers adjacent to each other; a plurality of rotors contained inside pump chambers; a rotating shaft that serves as an axis of rotation of the rotor; and a cooling medium path which is formed inside the division wall and through which a cooling medium passes.

4 Claims, 3 Drawing Sheets

MULTIPLE STAGE DRY PUMP

CROSS-REFERENCE TO RELATED APPLICATIONS

This is the U.S. National Phase Application under 35 U.S.C §371 of International Patent Application No. PCT/JP2009/005224 filed Oct. 7, 2009, which designated the United States and was published in a language other than English, which claims the benefit of Japanese Patent Application No. 2008-263938 filed on Oct. 10, 2008, both of them are incorporated by reference herein. The International Application was published in Japanese on Apr. 15, 2010 as WO2010/041445 A1 under PCT Article 21(2).

BACKGROUND OF THE INVENTION

1. Field of the Invention

The present invention relates to a positive-displacement dry pump.

2. Background Art

For vacuuming, a dry pump has been used. The dry pump is provided with a pump chamber in which a rotor is contained in a cylinder. In the dry pump, a rotor rotates in a cylinder, an exhaust gas is compressed and moves, and vacuuming is performed so as to reduce the pressure of a sealed space provided at an intake (for example, refer to Published Japanese Translation No. 2004-506140 of PCT International Publication).

Specifically, in a case where vacuuming is performed so as to obtain a medium vacuum or an excellent vacuum, a multiple-stage dry pump is used in which a plurality of pump chambers are connected in series from the intake of the exhaust gas to a discharge port (for example, refer to Japanese Unexamined Patent Application, First Publication No. 2003-166483).

When a dry pump is driven, an exhaust gas is compressed in the pump chamber and a heat is generated, and the temperature of a cylinder thereby rises.

When a temperature of the cylinder rises, the vacuuming efficiency is degraded.

Consequently, a dry pump is conventionally known, having a cooling medium path through which a cooling medium passes and which is formed at a peripheral portion of the cylinder, and uniformly cools down the entirety of the cylinder.

However, in the structure of the multiple-stage dry pump, as the pump chamber approaches an air side (discharge side), the inner pressure thereof may rise.

Because of this, as the pump chamber approaches an air side (discharge side), the amount of heat generation thereof may increase.

In the structure uniformly cooling down the entirety of the cylinder using a cooling medium or the like such as a conventional structure, difference in temperature between pump chambers occurs, and it is impossible to maintain the entirety of the dry pump at a uniform temperature. If a biased temperature occurs inside a dry pump, the dry pump is locally deformed, expanded, or the like, there is a problems in that the vacuuming efficiency is degraded.

SUMMARY OF THE INVENTION

The present invention was made in order to solve the above problems, and has an object to provide a dry pump in which it is possible to improve the vacuuming efficiency by suppressing uneven temperature which is locally generated.

In order to solve the above-described problems, the present invention provides the following dry pump. That is, a dry pump of the present invention includes: a plurality of cylinders; a pump chamber formed in each of the cylinders; a division wall separating pump chambers adjacent to each other; a plurality of rotors contained inside pump chambers; a rotating shaft that serves as an axis of rotation of the rotor; and a cooling medium path which is formed inside the division wall and through which a cooling medium passes.

In the dry pump of the present invention, it is preferable that the cooling medium path be formed inside the division wall separating at least the pump chamber positioned at a highest-pressure side in a plurality of the pump chambers in which inner pressures thereof are different from each other.

In the dry pump of the present invention, it is preferable that the cooling medium path be formed inside the division wall that separates at least the pump chamber which is closest to a discharge side in a plurality of the pump chambers that are connected in series from an inlet side toward a discharge side.

In the dry pump of the present invention, it is preferable that, at least in driving, the cooling medium path be formed inside the division wall that separates the pump chamber whose temperature becomes highest in a plurality of the pump chambers in which inner pressures thereof are different from each other.

EFFECTS OF THE INVENTION

According to the dry pump of the present invention, the cooling medium path is formed inside the division wall separating the pump chamber positioned at the highest-pressure side in a plurality of the pump chambers, the cooling medium flows therethrough, as a result, it is possible to effectively cool down the pump chamber which is close to an air side (discharge side).

Consequently, the imbalance of temperature is eliminated which is generated between the pump chamber which is close to an air side (discharge side) and the pump chamber disposed at the position anterior thereto.

Specifically, due to intensively cooling down the pump chamber which is close to an air side (discharge side), it is possible to increase the rotating speed of the rotor, and it is possible to realize the dry pump capable of effectively driving while improving the vacuuming efficiency.

Additionally, according to the dry pump of the present invention, the cooling medium path is formed inside the division wall separating the pump chamber whose temperature becomes highest in driving, the cooling medium flows therethrough, as a result, it is possible to effectively cool down the pump chamber in which the temperature thereof becomes highest.

DESCRIPTION OF THE PREFERRED EMBODIMENTS

Figure 1:
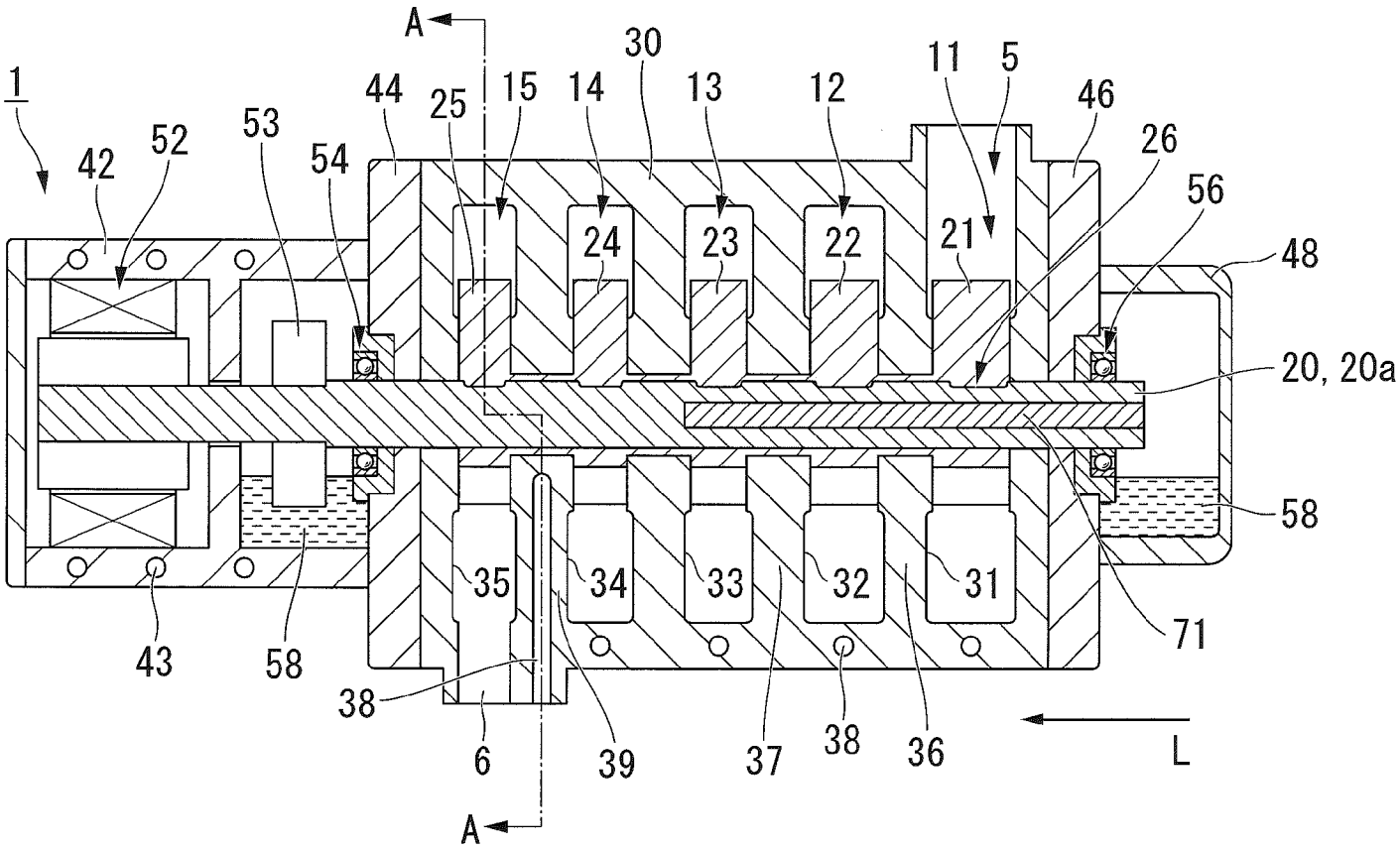
FIG. 1 is a cross-sectional side view showing a dry pump of the present invention.

Hereinafter, a best mode of a dry pump related to the present invention will be described with reference to drawings. The embodiment is specifically explained for appropriate understanding the scope of the present invention.

The technical scope of the invention is not limited to the below embodiments, but various modifications may be made without departing from the scope of the invention. Additionally, in the respective drawings referred to an below explanation, in order to make the respective components be of understandable size in the drawing, the dimensions and the proportions of the respective components are modified as needed compared with the real components.

Figure 2:
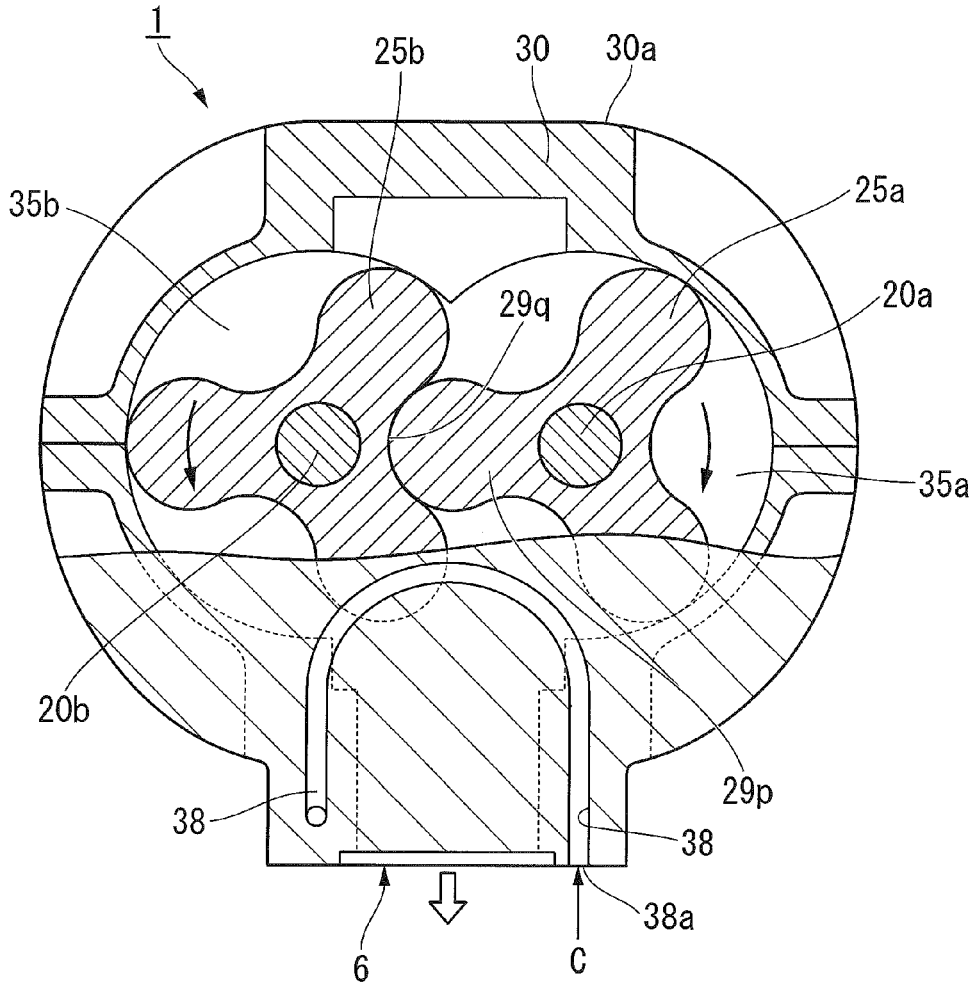
FIG. 2 is a cross-sectional front view showing a dry pump of the present invention.

FIG. 1 is a cross-sectional side view showing a dry pump of the present invention. FIG. 2 is a cross-sectional front view taken along the line A-A shown in FIG. 1.

In a multiple-stage dry pump 1, rotors 21, 22, 23, 24, and 25 in which the thicknesses thereof are different from each other are contained in cylinders 31, 32, 33, 34, and 35, respectively. Consequently, a plurality of pump chambers 11, 12, 13, 14, and 15 are formed along the axial direction L of a rotating shaft 20.

The dry pump 1 is provided with a pair of rotors 25*a* and 25*b* and a pair of rotors shafts 20*a* and 20*b*. The pair of rotors 25*a* and 25*b* are arranged such that a protuberance portion 29*p* of one of rotor 25*a* (first rotor) is engaged with a recessed portion 29*q* of the other of rotor 25*b* (second rotor). In cylinders 35*a* and 35*b*, the rotors 25*a* and 25*b* rotate along with rotation of the rotating shafts 20*a* and 20*b*.

When each of the rotors shafts 20*a* and 20*b* is rotated in an inverse direction for each other, the gas positioned between the protuberance portions 29*p* of each of the rotors 25*a* and 25*b* transfers along the inner surface of the cylinders 35*a* and 35*b*, and is compressed at a discharge port 6.

A plurality of the rotors 21 to 25 are arranged along the axial direction L of the rotating shaft 20. Each of the rotors 21 to 25 is engaged with a groove section 26 formed at the outer peripheral face of the rotating shaft 20, and the transferring thereof in the circumferential direction and the axial direction is regulated. A plurality of the pump chambers 11 to 15 are configured in which the rotors 21 to 25 are contained in the cylinders 31 to 35, respectively. The multiple-stage dry pump 1 is configured in which the pump chambers 11 to 15 are connected in series from the intake 5 of an exhaust gas toward the discharge port 6.

In a plurality of the pump chambers 11 to 15, the pump chamber (first pump chamber) 11 which is in touch with the intake 5 is a vacuum side, namely, a low pressure side. Additionally, the pump chamber (fifth pump chamber) 15 which is in touch with the discharge port 6 is an ordinary pressure side, namely, a high pressure side. Furthermore, the pump chamber 12 (second pump chamber), the pump chamber 13 (third pump chamber), and the pump chamber 14 (fourth pump chamber) are provided between the pump chamber 11 and the pump chamber 15.

With this configuration, since an exhaust gas is compressed and the pressure rises from the first pump chamber 11 of the intake 5 (vacuum side, low pressure step) to the fifth pump chamber 15 of the discharge port 6 (an air side, high pressure step), a displacement amount decreases in incremental steps in the pump chamber.

Specifically, the gas compressed in the first pump chamber 11 of the vacuum side flows to the second pump chamber 12.

The gas compressed in the second pump chamber 12 flows to the third pump chamber 13. The gas compressed in the third pump chamber 13 flows to the fourth pump chamber 14. The gas compressed in the fourth pump chamber 14 flows to the fifth pump chamber 15. The gas compressed in the fifth pump chamber 15 is evacuated from the discharge port 6. For this reason, a gas supplied from the intake 5 is gradually compressed through the pump chambers 11 to 15, and evacuated from the discharge port 6.

Each of the displacement amount of the pump chambers 11 to 15 is proportional to a scraping-out volume by the rotor and a rotating speed. Since the scraping-out volume by the rotor is proportional to a number of blades of rotor (a number of protuberance portions) and a thickness thereof, thicknesses of the rotors are determined such that the thicknesses thereof are gradually thin from the low pressure pump chamber 11 toward the high pressure pump chamber 15. In addition, in the dry pump 1 of the embodiment, the first pump chamber 11 is disposed at a free bearing 56 which is described below, and the fifth pump chamber 15 is disposed at a fixed bearing 54.

The cylinders 31 to 35 are formed inside a center cylinder 30. Side cylinders 44 and 46 are fixed to both end portions in the axial direction of the center cylinder 30. Bearings 54 and 56 are fixed to at a pair of the side cylinders 44 and 46, respectively.

The first bearing 54 fixed to the side cylinder 44 (first side cylinder) is a bearing having a little looseness in an axial direction such as an angular contact bearing or the like, and serves as a fixed bearing 54 regulating the movement of the rotating shaft in an axial direction. It is preferable that a grease 58 of fixed bearing 54 be enclosed in the side cylinder 44. On the other hand, the second bearing 56 fixed to the side cylinder 46 (second side cylinder) is a bearing having a great looseness in an axial direction such as a ball bearing or the like, and serves as a free bearing 56 allowing the movement of the rotating shaft in an axial direction.

The fixed bearing 54 supports rotatably the near center portion of the rotating shaft 20, and the free bearing 56 supports rotatably the near end portion of the rotating shaft 20.

A cap 48 is attached to the side cylinder 46 so as to cover the free bearing 56. It is preferable that a grease 58 of the free bearing 56 be enclosed inside the cap 48. On the other hand, a motor housing 42 is fixed to the side cylinder 44.

A motor 52 such as a DC brushless motor or the like disposed inside the motor housing. The motor 52 applies a revolution drive force to only the rotating shaft 20*a* (first rotating shaft) in a pair of the rotors shafts 20*a* and 20*b*. The revolution drive force is transmitted to the rotating shaft 20*b* (second rotating shaft) via a timing gear 53 placed between the motor 52 and the fixed bearing 54.

A plurality of pump chambers 11 to 15 are separated into each other by division walls 36 to 39 separating between adjacent pump chambers. The division walls 36 to 39 is formed integrally with, for example, the center cylinder 30 using the same material.

Here, the division wall 36 (first division wall) is provided between the pump chambers 11 and 12. The division wall 37 (second division wall) is provided between the pump chambers 12 and 13. The division wall (third division wall) is provided between the pump chambers 13 and 14. The division wall 39 (fourth division wall) is provided between the pump chambers 14 and 15. A cooling medium path 38 is formed inside a division wall adjacent to the fifth pump chamber 15 that becomes a highest-pressure side in the division walls 36 to 39, that is, inside the division wall 39 that separates the fifth pump chamber 15 which is in touch with the discharge port 6 (an air side, high pressure step) from the fourth pump chamber 14 which is anterior to the fifth pump chamber 15.

The cooling medium path 38 is a tubal flow passage extending in, for example, a substantially U-shape inside the division wall 39, and has a circular form in the cross section thereof.

Due to, for example, water as a cooling medium C flowing inside the cooling medium path 38, the division wall 39 is widely and efficiency cooled down. That is, the fifth pump chamber 15 of the high pressure side separated by the division wall 39 is broadly and intensively cooled down at the side face thereof.

In addition, one end 38*a* of the cooling medium path 38 is connected to a cooling medium supply source (not shown in the figure). Additionally, the cooling medium path 38 circulated inside the division wall 39 is not drawn inside the division walls 36 to 38, furthermore, passes only through a peripheral portion 30*a* of the center cylinder 30. Because of this, the pump chambers 12 to 14 are cooled down from a peripheral side thereof by the cooling force less than the cooling force for cooling down the pump chamber 15.

When the foregoing dry pump 1 is driven, a heat is generated by the compression work of the rotor or the like. Consequently, in a general case of trying to obtain a good pressure reached, regarding the amount of heat generation of each of pump chambers 11 to 15, as the pump chamber approaches the high pressure side (discharge side) that is a region close to the reached pressure, the inner pressure thereof increases, and the amount of heat generation thereof thereby increases. That is, the amount of heat generation increases toward the pump chamber 15 from the pump chamber 11, and the temperature becomes highest in the fifth pump chamber 15 that is a high pressure side.

The cooling medium path 38 is formed inside the division wall 39 separating the fifth pump chamber 15, the cooling medium C flows therethrough, as a result, it is possible to effectively cool down the fifth pump chamber 15 in which the temperature thereof becomes highest. Consequently, the imbalance of temperature is eliminated which is generated between the fifth pump chamber 15 and the pump chambers 11 to 14 that are anterior thereto.

Due to particularly and intensively cooling down the fifth pump chamber 15 which is a high pressure side (discharge side), it is possible to increase the rotating speed of the rotor, and it is possible to realize the dry pump capable of effectively driving while improving the vacuuming efficiency. Additionally, since an increase in temperature is suppressed in the fifth pump chamber 15 in which a heat is most generated, it is possible to prevent the properties of a constituent material of the rotor 25 from changing.

In addition, it is only necessary to form the cooling medium path inside the division wall separating at least the pump chamber 15 that is a high pressure side (discharge side), the cooling medium path may be formed inside the division wall separating the pump chambers 11 to 14 anterior to the pump chamber 15.

In this case, it is preferable that the cooling capability be changed in incremental steps in accordance with each amount of heat generation in the pump chambers 11 to 15 by, for example, decreasing the region on which the cooling medium path is formed toward the division wall 36 from the division wall 39 in incremental steps (e.g., the size of area on which the cooling medium path is formed (surface area), the length of the cooling medium path, or the like).

Additionally, depending on dry pump driving conditions, it is only necessary to form the cooling medium path inside the division wall that separates the pump chamber in which the amount of heat generation thereof is maximum. Namely, depending on the driving conditions, the amount of heat generation is not always maximum in the pump chamber that is a high pressure side (discharge side). For this reason, in a case where the pump chamber in which the amount of heat generation thereof is to be maximum is positioned at, for example, a low pressure side (inlet side), it is only necessary to form a cooling medium path inside a division wall separating the pump chamber adjacent to a low pressure side (inlet side).

EXAMPLES

Hereinafter, Examples that the effects of the present invention were verified are shown.

As Example of the present invention, as shown in FIGS. 1 and 2, a dry pump was used in which a cooling medium path 38 is formed inside a division wall 39 and a fifth pump chamber 15 of an air side (discharge side) is cooled down.

Furthermore, as Comparative Example, a conventional dry pump was used in which a cooling medium path is not formed inside a division wall separating a pump chamber of an air side (discharge side).

The foregoing dry pump of Example of the present invention and the dry pump of Comparative Example were driven for a predetermined period, and the temperature of the pump chamber of an air side (discharge side), the temperature of the pump chamber of a vacuum side (inlet side), and the temperature of the pump chambers disposed therebetween were measured. The measurement results are shown in FIG. 3.

Figure 3:
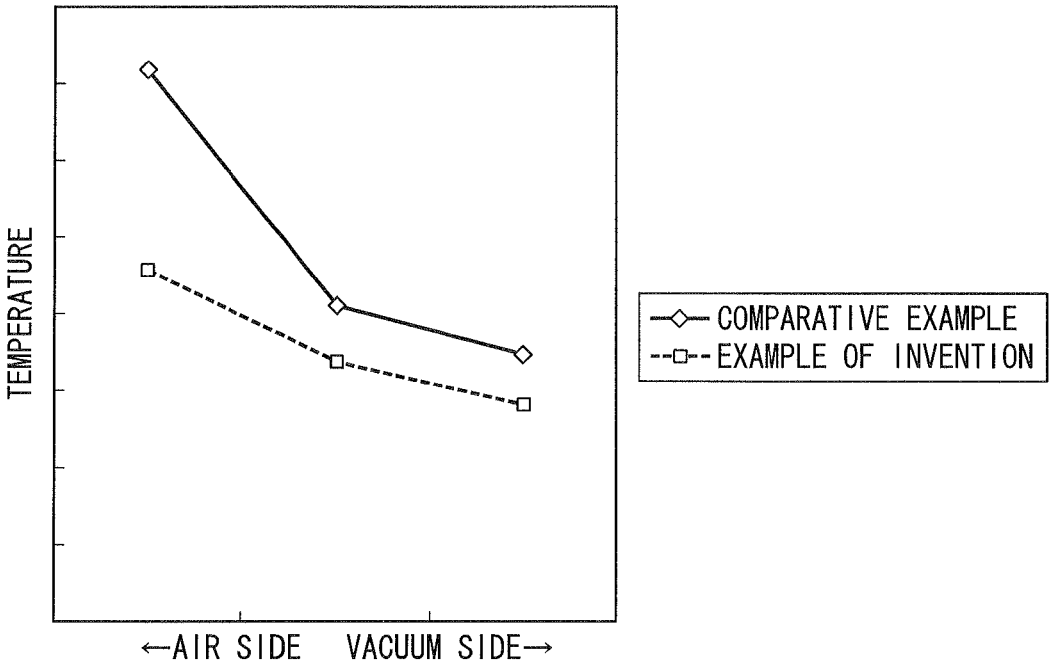
FIG. 3 is a view showing verification results in Example.

According to the measurement result shown in FIG. 3, in the dry pump of Example of the present invention, it was possible to totally decrease the temperature of the pump chamber lower than that of the dry pump of Comparative Example.

Specifically, in the dry pump of Example of the present invention, it was confirmed that the temperature of the pump chamber of an air side (discharge side) considerably decreases compared with the dry pump of Comparative Example and the total temperature distribution is stabilized.

Industrial Applicability

As described in detail, the present invention is applicable to a dry pump in which it is possible to improve the vacuuming efficiency by suppressing uneven temperature which is locally generated.

What is claimed is:

1. A dry pump comprising:

a plurality of cylinders;

a pump chamber formed in each of the cylinders;

a division wall separating pump chambers adjacent to each other;

a plurality of rotors contained inside pump chambers;

a rotating shaft that serves as an axis of rotation of the rotor; and a cooling medium path which is formed at least inside the division wall separating at least the pump chamber positioned at a highest-pressure side in a plurality of the pump chambers in which inner pressures thereof are different from each other and through which a cooling medium passes, wherein a region on which the cooling path is formed is decreased in incremental steps toward the division wall separating the pump chamber positioned at a lowest-pressure side from the division wall separating the pump chamber positioned at a highest-pressure side.

2. The dry pump according to claim 1, wherein, the cooling medium path is formed inside the divisional wall that separates the pump chamber whose temperature becomes highest in driving in a plurality of the pump chambers in which inner pressures thereof are different from each other.

3. A dry pump comprising:

a plurality of cylinders;

a pump chamber formed in each of the cylinders;

a division wall separating pump chambers adjacent to each other;

a plurality of rotors contained inside pump chambers;

a rotating shaft that serves as an axis of rotation of the rotor; and a cooling medium path formed inside the division wall separating the pump chamber positioned at a highest-pressure side in a plurality of the pump chambers in which inner pressures thereof are different from each other and through which a cooling medium passes, wherein the cooling medium path is not drawn inside the division wall other than that separating the pump chamber positioned at a highest-pressure side, and passes only through a peripheral portion of a center cylinder.

4. The dry pump according to claim 3 , wherein the cooling medium path is formed in a U-shape inside the division wall.

* * * * *